US005155294A

United States Patent [19]

Vesa

[11] Patent Number: 5,155,294

[45] Date of Patent: Oct. 13, 1992

[54] SUBWARHEAD

[75] Inventor: Reijo Vesa, Karlskoga, Sweden

[73] Assignee: AB Bofors, Bofors, Sweden

[21] Appl. No.: 680,362

[22] Filed: Apr. 4, 1991

[30] Foreign Application Priority Data

Apr. 4, 1990 [SE] Sweden ..... 9001227

[51] Int. Cl.[5] ..... F42B 1/02; F42B 13/00

[52] U.S. Cl. ..... 102/384; 102/387; 244/3.28

[58] Field of Search ..... 102/393, 489, 384, 386, 102/387, 388; 244/3.28, 3.27

[56] References Cited

U.S. PATENT DOCUMENTS 4,858,532 8/1989 Persson et al. ..... 102/387

*Primary Examiner*—David H. Brown

*Attorney, Agent, or Firm*—Pollock Vande Sande & Priddy

[57] ABSTRACT

A submunition which is arranged to be separated from a missile or projectile for example, a shell canister or the like, over a target area including an active part, in the form of a warhead, a target detector and means for imparting to the submunition a controlled rotation for scanning of the target area in a helical pattern during the descent of the submunition towards the target area. The target detector is displaceable in order to allow a free view at the side of the warhead. The two diametrically situated aerofoils are pivotable from a folded position, in which the aerofoils connect with the outer surface of the submunition, to a 90° unfolded position, in which the two aerofoils form a braking area for controlling the rate of descent of the submunition. The two aerofoils are pivotally arranged via a double joint.

7 Claims, 2 Drawing Sheets

SUBWARHEAD

FIELD OF THE INVENTION

The present invention relates to a subwarhead (submunition) arranged to be separated from a projectile missle, for example a shell canister or the like, over a target area, the submunition comprising an active part in the form of a warhead, a target detector and means for imparting to the submunition a rotation for scanning the target area in a helical pattern during the descent of the submunition towards the target area. Such a submunition is previously described in the U.S. Pat. No. 4,858,532.

In the submunition described in the above patent the target detector is arranged pivotably on a bearing shaft which is parallel with the line of symmetry of the active part (warhead) in order to allow pivoting out of the target detector from a folded position, in which the optical axis of the target detector coincides with the line of symmetry of the active part, to an unfolded position, in which the optical axis of the target detector is parallel with the line of symmetry of the warhead, in order to allow a free view by the target detector at the side of the active part, and furthermore an aerofoil is pivotably arranged on a bearing shaft which is also parallel to the line of symmetry of the active part in order to allow pivoting out of the aerofoil from a folded position to an unfolded position at the side of the warhead.

By means of an expedient aerodynamic design of the submunition and the braking area of the detector and the aerofoil, a suitable rate of descent of the submunition and furthermore a driving moment, which imparts to the submunition its rotation, around the axis of spin are obtained. This is brought about without assistance from a parachute, which is an advantage since the parachute takes up space. Within the available space in a canister, an increased space can instead be made available for the warhead itself.

Although the submunition described above has proved to have good characteristics as far as rate of descent and scanning rotation are concerned, it has become desirable to be able to further increase the braking area. This can be the case, for example, when it is desired to use heavier warheads. The braking area of the target detector and aerofoil is limited to the cross-sectional area of the cylindrical submunition, which can result in the rate of descent becoming too high with the existing size of the braking area if the weight of the warhead is increased at the same time.

In U.S. allowed patent application Ser. No. 599,852, a submunition is described, in which the braking area has been made considerably greater. It's structure includes two diametrically situated aerofoils which are each arranged, on their own shaft situated in a plane which is perpendicular to the axis of symmetry of the warhead, to be pivotable from a folded position, in which the aerofoils connect with the outer surface of the submunition , to a 90° unfolded position, in which the two aerofoils form a braking area for the rate of descent of the submunition.

The aerofoils are in this case made of an elastically flexible material so that, when they pivot out from their folded position, they are simultaneously bowed out into a mainly straight or slightly curved surface.

The advantage of the construction described above, in addition to the greater braking area, is that the two aerofoils can be made comparatively thin, which is favorable as far as weight is concerned. The aerofoils can be made, for example, of titanium, and curved so that they have a given radius in their unfolded position. The curvature can be varied and the aerofoils can be of different length, in which respect further parameters are obtained for varying the flight characteristics.

SUMMARY OF THE INVENTION

The object of the present invention is to further improve the characteristics of a submunition of the type mentioned above, and in particular to design the subwarhead so that the size of the warhead can be increased.

A further object of the invention is to design the folding-out mechanism in a robust manner without for this reason encroaching upon the space for the warhead.

The invention is described below in greater detail with reference to the attached drawings which show an example of how a submunition according to the invention can be designed.

DETAILED DESCRIPTION OF THE PREFERRED EMBODIMENT

Figure 1:
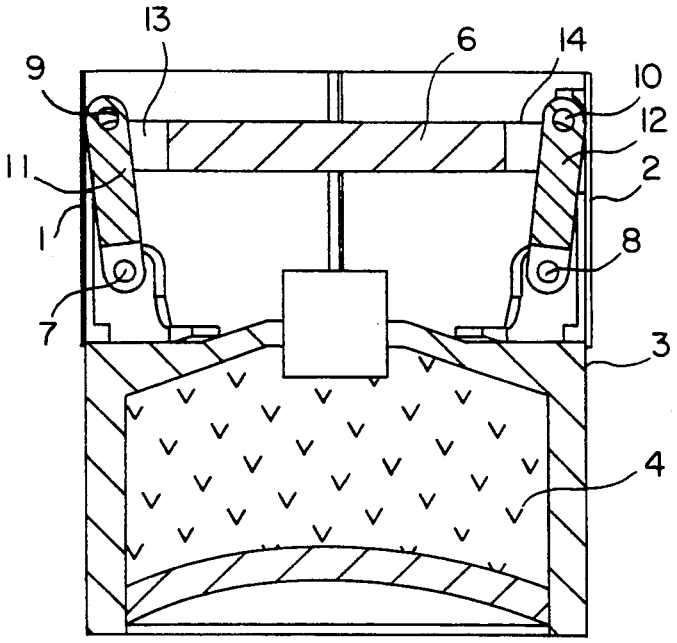
FIGS. 1 and 2, show the submunition of the present invention in its folded position.
Figure 2:
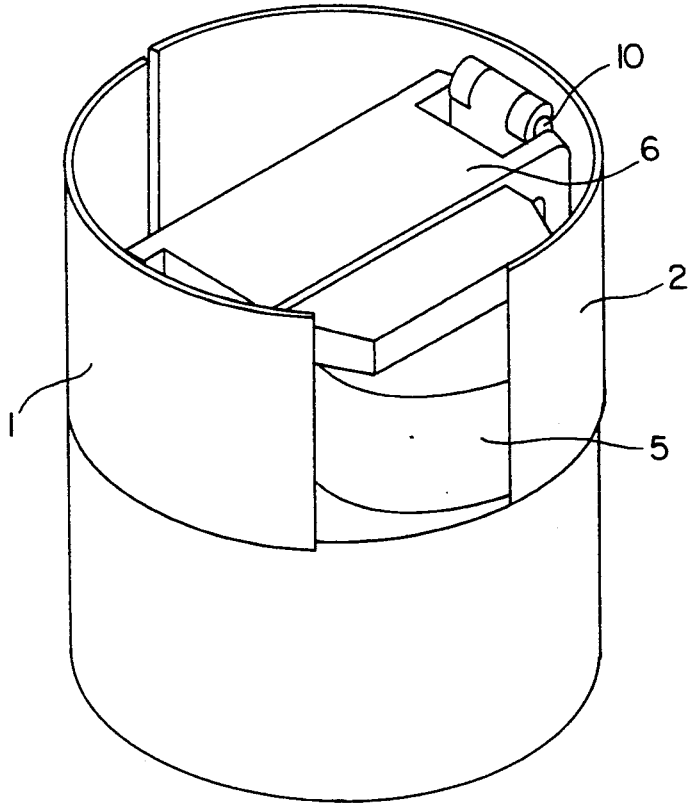
Figure 3:
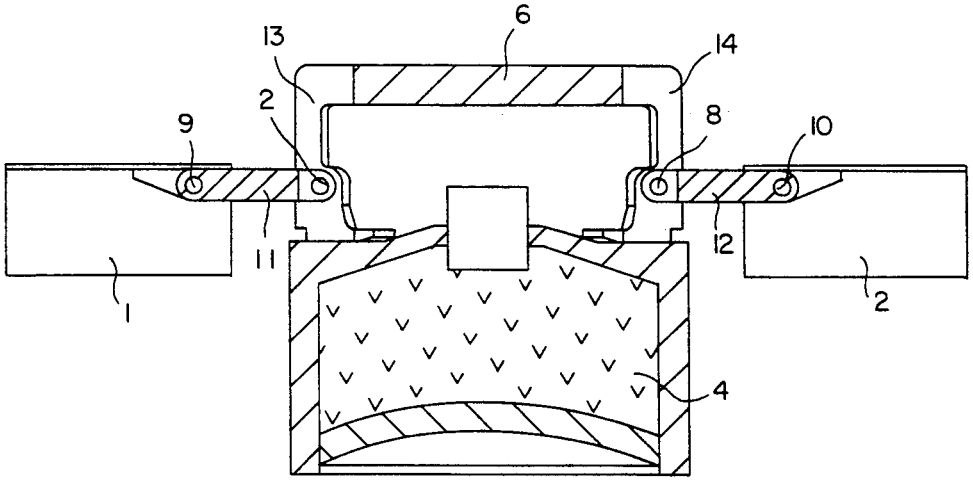
FIGS. 3 and 4 show the submunition in its unfolded position.

The submunition is assumed to have been separated from a canister in a carrier shell. The carrier shell can be of 15.5 cm caliber, for example, which has been fired from a field artillery piece in a conventional manner in a ballistic trajectory towards a target area. In order to give the submunition a controlled movement of scanning of the target area, that is to say a controlled rotation and rate of descent, two diametrically located aerofoils 1, 2 are arranged to be pivotable from a folded-in position, as shown in FIGS. 1 and 2, in which the aerofoils connect with the outer surface 3 of the submunition, to an unfolded position, in which the two aerofoils form a braking area, as shown in FIGS. 3 and 4.

Figure 4:
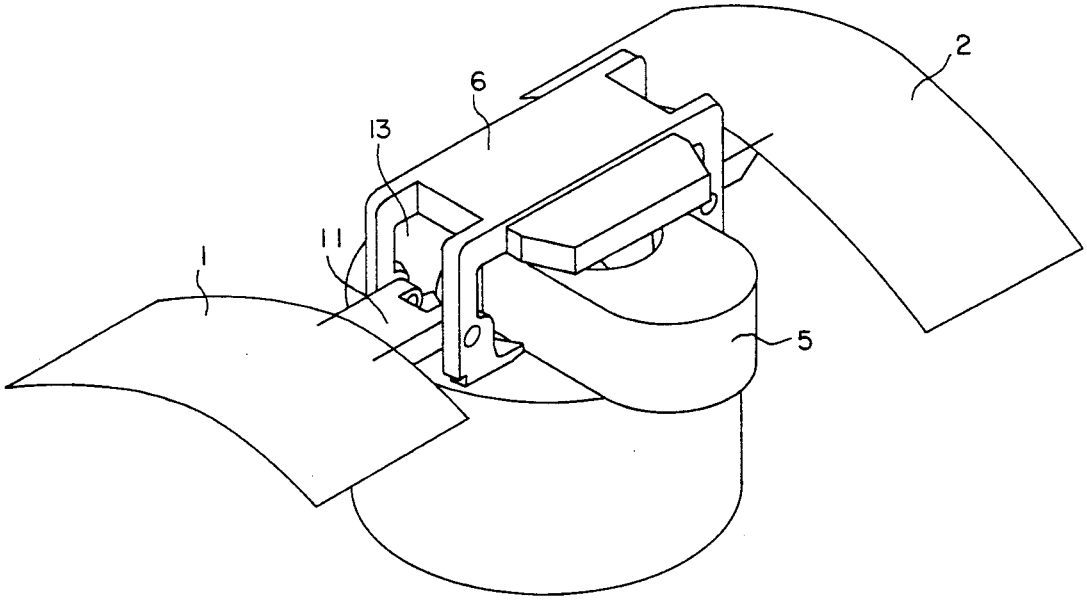

The submunition comprises a warhead 4 and a target detector 5 which is arranged displaceably from a folded position in the stirrup-like superstructure 6 on the warhead to an unfolded position, see FIG. 4, in which it has a free view at the side of the warhead. The warhead and the target detector are of types known in the art and are therefore not described in greater detail here.

The aerofoils themselves 1, 2 can be made in the manner which is indicated in the U.S. allowed patent application Ser. No. 599,852 which is mentioned in the introduction. In contrast with the latter, however, the aerofoils are each suspended in a double joint, which consists of two unfolded shafts, on one hand a shaft 7, 8 arranged in the lower part of the stirrup-like superstructure 6 on the subwarhead and on the other hand a shaft 9, 10 fastened in the underside of the aerofoil 1, 2 itself. The two shafts are connected through an arm 11, 12.

The advantage of this arrangement, compared with pivotability about only one folding-out shaft as in the previously known submunition, is that the folding-out shafts 7, 8 in the stirrup-like superstructure 6 can be positioned as low as possible on the submunition and in spite of this provide increased width of the aerofoils and consequently our increased braking area which is desired.

A further advantage of pivotability about two shafts (double joint) is that, in their folded position, the aerofoils connect with the upper part of the submunition, as shown in FIG. 1, and do not surround the warhead 4 itself. Although the aerofoils are comparatively thin, the aerofoils still require a given space which can now instead be used to increase the diameter of the warhead 4. Moreover, the aerofoils 1 and 2 can now, in their folded position, be used as a cover for the upper part of the submunition and protect the target detector, detonator and the like which are positioned there.

The shafts 7, 8 are positioned in a plane which is perpendicular to the line of symmetry of the warhead. The shafts 9, 10 also are positioned in a plane which is perpendicular to the line of symmetry. In the folded position, as shown in FIG. 1, this plane is situated above the plane with the shafts 7, 8, while the shafts 9, 10 follow a circular trajectory to the unfolded position, in which the shafts lie in a plane which substantially coincides with the plane, in which the fixed bearing shafts are arranged.

In the folded position, the shafts 9, 10 are situated slightly outside the bearing shafts 7, 8 in relation to the axis of symmetry of the submunition. The bearing shafts 9, 10 are suspended on the undersides of the aerofoils 1, 2 at approximately a quarter of the distance from the inner edge, respectively upper edge in the folded position, of the aerofoils.

The connecting arms 11, 12, which connect the two bearing shafts in the double joint, are comparatively wide, as shown in FIG. 4, to provide higher durability. The stirrup-like superstructure 6 is provided with diametrically situated recesses 13, 14 for the arms 11, 12 in the folded position.

The aerofoils are folded out from their folded position by means of the rotational forces. Expediently, a damping element is installed so that the aerofoils are stopped gently in the unfolded position and the risk of oscillations is reduced. Furthermore, locking elements are arranged in the inner joint 7, 8 in order to lock the aerofoils in the unfolded position, for example a simple snap lock or locking hook.

What I claim and desire to secure by Letters Patent is:

1. In a submunition of a type which is separatable from an aeronautical body over a target area and includes a warhead, a target detector mounted on the warhead and being displaceable to an extended position allowing a free view and aerofoils mounted on said warhead, all arranged such that a controlled rotation is imparted to the submunition for scanning the target area in a helical pattern during the fall of the submunition towards the target area;

an improvement comprising means for pivotally mounting said aerofoils on said warhead, said means comprising:

a double joint means for each said aerofoil each said aerofoil being pivotable about its double joint means from a folded position, in which said aerofoils are in contact with the outer surface of said submunition, outwardly by about 90° to an unfolded position, in which said aerofoils form a braking area for controlling the rate of descent of said submunition.

2. A submunition according to claim 1, wherein each said double joint means comprises a first bearing shaft mounted in the housing of said submunition and a second bearing shaft arranged on said aerofoil, said two bearing shafts being interconnected through a connecting member.

3. A submunition according to claim 2 wherein said bearing shafts lie in planes which are perpendicular to the axis of symmetry of said submunition.

4. A submunition according to claim 2 wherein each said second bearing shaft in said unfolded position of said aerofoils, is positioned in substantially the same plane as said first bearing shaft while, in said folded position of the aerofoils, said second bearing shaft is positioned above said first fixed bearing shaft.

5. A submunition according to claim 4 wherein said second bearing shafts in said folded position of said aerofoils are located slightly outside said first bearing shafts in relation to the axis of symmetry of said submunition.

6. A submunition according to claim 1 wherein said aerofoils in said folded position enclose the upper part of the submunition.

7. A submunition according to claim 6, wherein said second bearing shafts are arranged on the underside of said aerofoils at a distance from the upper or, in said unfolded position, inner edge of said aerofoils.

* * * * *